United States Patent [19]

Marks et al.

[11] 4,082,926

[45] Apr. 4, 1978

[54] IGNITION DISTRIBUTOR ROTOR WITH CORONA GENERATING POINTS OF ELECTRICALLY CONDUCTIVE PAINT

[75] Inventors: Stephen W. Marks; Robert E. Marsh, both of Anderson, Ind.

[73] Assignee: General Motors Corporation, Detroit, Mich.

[21] Appl. No.: 709,786

[22] Filed: Jul. 29, 1976

[51] Int. Cl.[2] ..... H01H 19/10; F02P 1/00

[52] U.S. Cl. ..... 200/19 DR; 123/146.5 A; 200/19 R

[58] Field of Search ..... 200/19 R, 19 A, 19 DR, 200/19 DC; 123/146.5 A, 146.5 R

[56] References Cited

U.S. PATENT DOCUMENTS

| | | | |
|---|---|---|---|
| 2,399,023 | 4/1946 | Harkness | 200/19 |
| 3,887,780 | 6/1975 | Crim | 200/19 DR |
| 3,941,107 | 3/1976 | Rockwell | 200/19 DR |
| 3,949,721 | 4/1976 | Hori et al. | 200/19 R X |

*Primary Examiner*—James R. Scott
*Attorney, Agent, or Firm*—Richard G. Stahr

[57] ABSTRACT

To reduce the potential magnitude necessary to break down the arc gap between an ignition distributor rotor segment output tip and each of the output electrodes of an associated distributor cap, a pair of electrical conductor members in electrical contact with the rotor body and segment at an area radially inwardly from the output tip of the segment are provided. These conductor members extend radially outwardly toward the rotor segment output tip in a manner to define a pair of circumferentially displaced terminating points in bracketing relationship with the output tip.

4 Claims, 5 Drawing Figures

IGNITION DISTRIBUTOR ROTOR WITH CORONA GENERATING POINTS OF ELECTRICALLY CONDUCTIVE PAINT

BACKGROUND OF THE INVENTION

The subject invention is directed to an ignition distributor rotor and, more specifically, to an ignition distributor rotor having at least one electrical conductor member in electrical contact with the electrically conductive rotor segment and the electrically nonconductive rotor body radially inwardly from the output tip of the rotor segment and extending radially outwardly toward the output tip in a manner to define a terminating point.

Most modern internal combustion engine ignition systems contain two arc gaps in the secondary circuit of the ignition coil, the distributor rotor gap between the distributor rotor segment output tip and the distributor cap output terminal with which it is in register and one of the spark plugs. It is well-known that a primary source of automotive radio frequency interference is the large fast rise time impulsive current which flows at the onset of electrical breakdown of both the distributor rotor gap and the spark plugs. When the ignition coil primary winding energizing current is interrupted, the ignition coil secondary output, $v(t)$, decreases nearly linearly from zero at the rate of $10^9$ volts per second. In an ignition circuit, $v(t)$ appears almost entirely across the distributor rotor gap prior to the breakdown of this gap. It has been learned that the controlling factor in determining the breakdown voltage for a given distributor rotor gap geometry is the supply of electrons to start the breakdown process leading to arc formation and that an inadequate supply of initiatory electrons leads to high breakdown voltages. In general, an inadequate supply of initiatory electrons creates faster rising time pulses of increased magnitude through the distributor rotor gap, a condition which increases radio frequency interference radiation.

The initiation of distributor rotor gap breakdown depends only upon $v(t)$. Changes in the circuit which do not alter $v(t)$ prior to breakdown cannot be expected to alter the breakdown voltage. For a given circuit and distributor rotor gap geometry, it is generally observed that the larger the breakdown voltage, the larger will be the resulting $di/dt$ and radio frequency interference. With a fixed direct current potential applied across the distributor rotor gap, the conduction of electricity across the distributor rotor gap takes place by the transport of free electrons and ions. An initiatory electron, the first free electron to appear in the distributor rotor gap, is accelerated by the applied electric field and collides with the individual molecules of the air within the distributor rotor gap. There is a certain mathematical probability that these collisions will result in ionization which leads to electron multiplication. This probability may be expressed as the average number of ionizing events per electron per unit length of drift in the direction of the applied electric field. This quantity is a function of $E/t$ where E is the applied electric field and $t$ is the gas pressure within the distributor rotor gap. Because of their much greater mass, the ions produced are left behind the advancing electron avalanche. To form an arc in the distributor rotor gap capable of carrying the required spark plug arc current at low distributor rotor gap voltages, the electron and ion densities in the distributor rotor gap must be increased far beyond that produced by a single avalanche. To achieve multiple avalanches leading to an arc, the initiatory electron must be replenished before the avalanche reaches the positive electrode. Nothing can happen until the initiatory electron appears. The supply of initiatory electrons is a limiting factor in reducing the implusive breakdown found in the distributor rotor gap. Because of the rapid fall of the ignition coil secondary winding output, the potential across the distributor rotor gap is at or slightly above the direct current breakdown potential for only a very short period of time. When the applied voltage V is greater than the direct current breakdown voltage $V_B$, the distributor rotor gap is said to be overvolted. The overvoltage is defined as a ratio $V/V_B$.

If an initiatory electron is not present while the overvoltage is low, the coil output will continue to fall until the applied electric field becomes sufficiently intense to produce the initiatory electron, presumably by electron emission from the rotor segment. It is not uncommon to observe overvoltage ratios of 2:5 in distributor rotor gaps. In this event, the multiplication of the initiatory electron is enormously enhanced. Hence, the avalanche forms much more quickly and with more rapid electron multiplication under these highly overvoltage conditions which, in turn, leads to a more rapid rise in arc current flow through the distributor rotor gap and associated circuitry and to increase radio frequency interference. Therefore, an ignition distributor rotor of the type which produces a large corona effect for efficiently injecting electrons into the distributor rotor gap which serve as initiatory electrons is desirable.

SUMMARY OF THE INVENTION

It is, therefore, an object of this invention to provide an improved ignition distributor rotor.

It is another object of this invention to provide an improved ignition distributor rotor having a body member of a high dielectric strength electrically nonconductive material and an electrically conductive rotor segment electrically interconnected therewith.

It is an additional object of this invention to provide an improved ignition distributor rotor having at least one electrical conductor member in electrical contact with the electrically conductive rotor segment and the electrically nonconductive rotor body radially inwardly from the output tip of the rotor segment and extending radially outwardly toward the output tip of the rotor segment in a manner to define a terminating point.

It is an additional object of this invention to provide an improved ignition distributor rotor which produces a large corona effect for efficiently injecting electrons into the distributor rotor gap which serve as initiatory electrons.

BRIEF DESCRIPTION OF THE DRAWINGS

For a better understanding of the present invention, together with additional objects, advantages and features thereof, reference is made to the following description and accompanying drawing in which.

In the several figures of the drawing, like elements have been assigned like numerals of reference.

DETAILED DESCRIPTION OF THE PREFERRED EMBODIMENT

Figure 1:
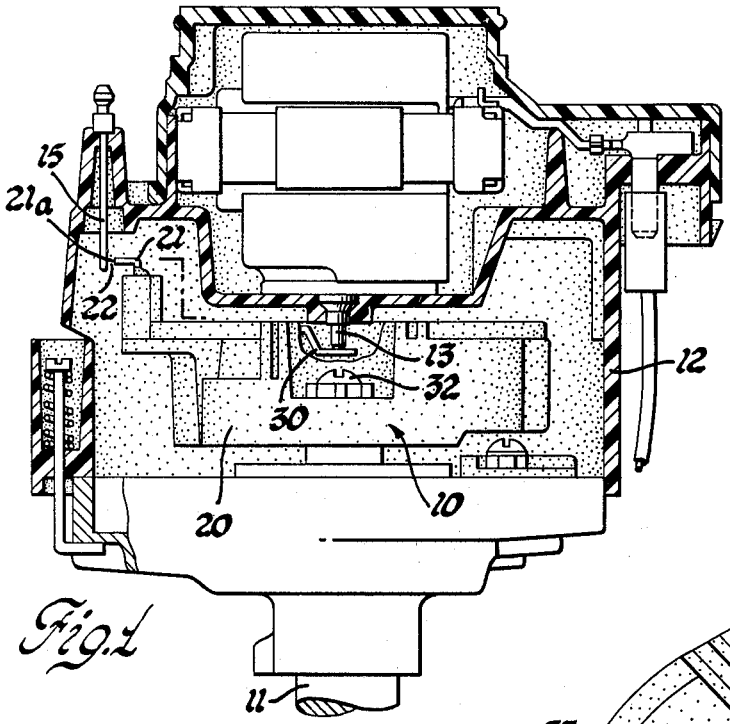
FIG. 1 is a vertical section view of a portion of an ignition distributor showing the distributor rotor member of this invention mounted therein.

As is well-known in the automotive art, the ignition distributor rotor 10, FIG. 1, is rotated by a driving shaft 11, usually gear-coupled to the camshaft of the associated internal combustion engine, within a distributor cap 12 having a center input terminal 13, to which is connected one end of the associated ignition coil secondary winding, and a plurality of output terminals, one of which is shown at 15, circumferentially arranged about the input terminal 13, to which the spark plugs are connected through respective spark plug leads in a manner well-known in the automotive art. Although only one output terminal is shown in FIG. 1, in which the distributor cap 12 is illustrated in cross-section, it is to be specifically understood that an output terminal is provided for each of the engine spark plugs and that they are circumferentially arranged about the center input terminal in a manner well-known in the automotive art.

The ignition distributor rotor of this invention comprises a body member 20 of an electrically nonconductive material adapted to engage and be rotated by driving shaft 11, a rotor segment member 21 of an electrically conductive material such as copper supported by body member 20 and having an output tip portion **21*a* which is passed in arc gap relationship with successive ones of the output terminals of distributor cap 12 as body member 20 is rotated by shaft 11. While rotor segment member 21 is rotated with body member 20, the output tip portion 21*a* traces a circular path radially inwardly from the circumferentially disposed distributor cap output terminals by a distance equal to the predetermined distributor rotor gap 22. Without intention or inference of a limitation thereto, rotor segment 21 may be of a rectangular cross-section and may be placed in electrical circuit arrangement with center electrode 13 through a contact member 30 of an electrically conductive material such as copper or stainless steel. Contact member 30 is arranged to be in intimate electrical contact with rotor segment member 21 along adjacent surfaces of both under retaining member 31 and is arranged to be electrically connected to center input terminal 13 of distributor cap 12. Alternatively, rotor segment member 21 may be of sufficient length to electrically contact center input terminal 13 without departing from the spirit of the invention. In a practical application, the electrically nonconductive material of which body member 20 is made is a 30 percent glass reinforced thermoplastic polyester molding material. Body member 20 may be secured to the distributor centrifugal weight base, not shown, by screws, one of which is illustrated in FIG. 1 and referenced by the numeral 32. As the distributor weight base is rotated by shaft 11 in a manner well-known in the art, rotor member 10 is rotated therewith. One example of an ignition distributor with which the distributor rotor of this invention may be used is disclosed and described in U.S. Pat. No. 3,923,028, R. W. Campbell et al., which issued Dec. 2, 1975 and is assigned to the same assignee as is this application. It is to be specifically understood, however, that any other arrangement through which body member 20 is adapted to engage and be rotated by driving shaft 11** may be employed without departing from the spirit of this invention.

In the preferred embodiment illustrated in the drawing, contact member 30 is shown to be an elongated contact member of an electrically conductive material such as copper or stainless steel in intimate electrical contact with rotor segment member 21 with one end thereof arranged to be electrically connected to center input terminal 13 of distributor cap 12. With this arrangement, the ignition spark potential produced by the secondary winding of the associated ignition coil may be delivered to successive ones of the distributor cap output terminals as rotor body member 20 is rotated by driving shaft 11 in timed relationship with the associated internal combustion engine, in a manner well-known in the art, through center input terminal 13, contact member 30, rotor segment member 21 and the distributor rotor gap 22 between the output tip portion **21*a* of rotor segment 21** and each of the distributor output terminals.

Figure 2:
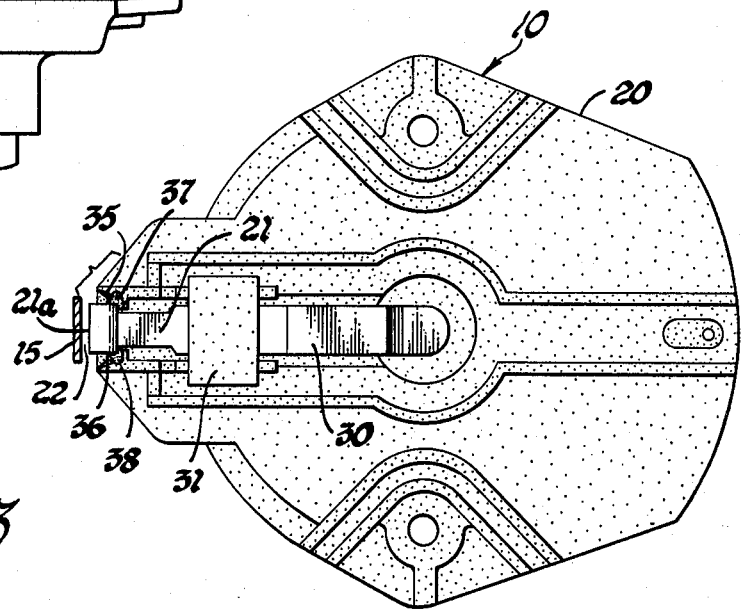
FIG. 2 is a top view of the distributor rotor of this invention showing, in addition, the relationship between the rotor tip and one of the distributor output terminals.
Figure 4:
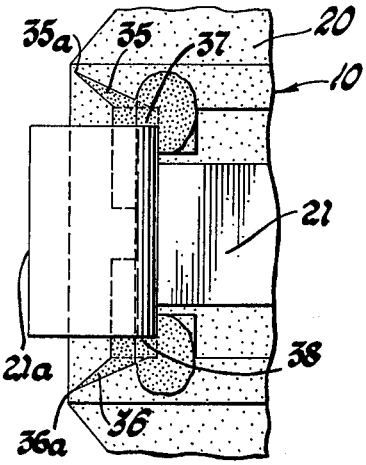
FIG. 4 is an enlarged top view of a portion of the ignition distributor rotor of this invention.
Figure 5:
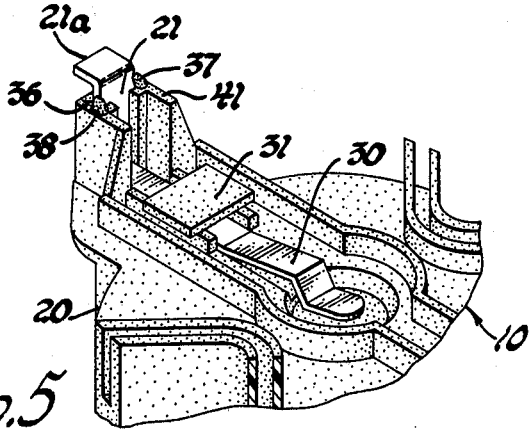
FIG. 5 is a perspective view of a portion of the ignition distributor rotor of this invention.

To reduce the potential required to ionize the distributor rotor gaps and thus reduce the radiated radio frequency interference, a pair of electrical conductor members 35 and 36, best seen in FIGS. 2, 4 and 5, in electrical contact with body member 20 and segment member 21 and supported by body member 20 in a plane axially displaced from and substantially parallel to the circular path traced by output tip portion 21 are provided. Conductor members 35 and 36 are in electrical contact with rotor body member 20 and rotor segment 21 radially inwardly from the output tip portion **21*a* of rotor segment 21 and extend radially outwardly from the respective areas of electrical contacts 37 and 38 between body member 20 and segment member 21 toward output tip portion 21*a* in a manner to define a pair of circumferentially displaced terminating points 35*a* and 36*a* in bracketing relationship with output tip portion 21*a*. Each of electrical conductor members 35 and 36 are in intimate electrical contact with rotor segment member 21 and body member 20 for electrically interconnecting rotor segment 21 and body member 20. Each of conductor members 35 and 36, in addition to being in intimate electrical contact with rotor segment member 21 and body member 30 are tapered to respective points 35*a* and 36*a* in the direction radially outwardly from the area of this electrical contact toward output tip portion 21*a*. One example, and without intention or inference of a limitation thereto, of these electrical conductor members 35 and 36 may be a silver filled paint of sufficient thickness to not only be electrically bonded to both rotor segment member 21 and body member 20 but also to electrically bridge the space therebetween for electrically interconnecting rotor segment member 21 and body member 20. One example of a silver filled paint suitable for this purpose is marketed by Dynaloy Corporation and is identified as "Dynaloy 340". It is to be specifically understood, however, that any other electrically conductive element or elements may be employed to provide at least one electrical connection between rotor segment 21 and body member 20** without departing from the spirit of the invention.

Figure 3:
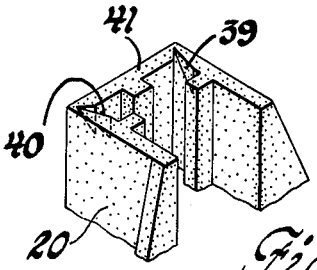
FIG. 3 is an enlarged perspective view of a portion of the body member of the ignition distributor rotor of this invention.

To provide for electrical conductors 35 and 36, corresponding depressions 39 and 40, both seen in FIG. 3, may be milled or molded into a ledge portion 41 of rotor body member 20. These depressions are so formed as to provide respective terminating points and are filled with the aforementioned electrically conductive paint. The excess paint is removed in a subsequent milling step so that the conductive paint conductors 35 and 36 extending outwardly from the area of electrical contact between rotor segment member 21 and rotor body member 20 are flush with the ledge portion 41 of body member 20.

The terminating points 35*a* and 36*a* of electrical conductor members 35 and 36 are excellent corona generators as they provide a considerable intensification of the electric field across distributor rotor gap 22. This is because of the favorable geometry of the respective terminating tips 35*a* and 35*b* of the electrical conductor members 35 and 36 and, in addition, the plastic ledge 41 of body member 20 becomes polarized because of its electric properties thereby further increasing the field at the sharp points. The mechanism responsible for the desirable behavior of the distributor rotor of this invention is believed to be because, for applied voltages below the breakdown voltage of the ignition distributor gap 22, a sufficient electrical field is developed at the respective terminating points 35*a* and 36*a* of electrical conductor members 35 and 36 to produce a corona effect which results in a large number of initiatory electrons, presumably by field emission. These electrons multiply and rapidly accelerate into a large solid angle away from the terminating tips 35*a* and 36*a* of electrical conductor members 35 and 36, thereby distributing themselves over a large portion of the distributor rotor gap 22 volume. As the field continues to increase, there are many initiatory electrons available to initiate the avalanche. Because the distributor rotor gap 22 between rotor segment member 21 and the distributor output terminals is shorter than the gap between the distributor output terminals and the terminating points 35*a* and 36*a* of electrical conductor members 35 and 36 and since the output tip portion 21*a* of rotor segment member 21 is itself more blunt, thereby allowing higher field strength over the entire ignition distributor gap, the initiated arc is across the distributor rotor gap 22 rather than across the terminating points 35*a* and 36*a* of electrical conductor members 35 and 36 and the distributor gap output terminals.

It is to be specifically understood that other alternative methods of providing the conductor members which terminate in a pair of circumferentially displaced terminating points in bracketing relationship with the output tip portion 21*a* of rotor segment member 21 may be employed without departing from the spirit of the invention. It is only necessary that the electrical conductor members 35 and 36 be arranged to produce a concentrated electrical field to generate a strong corona effect within the distributor rotor gap 22 and be so positioned as to minimize the probability of the arc striking across the terminating tips thereof and the rotor gap output terminals. Because of this requirement, electrical conductor members 35 and 36 are arranged to terminate in points and are located as far from rotor member 21 as possible yet still be in the area of the distributor cap insert to provide maximum corona effectiveness within the distributor rotor gap 22.

In a practical application of the rotor of this invention, the required breakdown potential was below 12 kilovolts which provides a significant reduction of radiated radio frequency interference.

While a preferred embodiment of the present invention has been shown and described, it will be obvious to those skilled in the art that various modifications and substitutions may be made without departing from the spirit of the invention which is to be limited only within the scope of the appended claims.

What is claimed is:

1. In an ignition distributor rotor of the type adapted to be rotated about its axis within a distributor cap having a plurality of output terminals circumferentially disposed about the rotor axis of rotation and including a body member of an electrical insulating material;

a segment member of an electrically conductive material supported by said body member and having an output tip portion that traces a circular path radially inwardly from said circumferentially disposed distributor cap output terminals by a predetermined arc gap while said segment member is rotated with said body member and a pair of electrical conductor members of an electrically conductive paint in electrical contact with said body and segment members radially inwardly from said output tip portion of said segment member and supported by said body member in a plane axially displaced from and substantially parallel to said circular path traced by said output tip portion, the improvement comprising:

respective depressions in said body member that are filled by said electrically conductive paint, are shaped to form the said electrically conductive paint contained therein into respective sharp terminating points, are so positioned that the said electrically conductive paint contained therein extends outwardly toward said output tip portion and are so oriented that said sharp terminating points define a pair of circumferentially displaced sharp corona generating points in bracketing relationship with said output tip portion.

2. In an ignition distributor rotor of the type adapted to be rotated about its axis within a distributor cap having a plurality of output terminals circumferentially disposed about the rotor axis of rotation and including a body member of an electrical insulating material;

a segment member of an electrically conductive material supported by said body member and having an output tip portion that traces a circular path radially inwardly from said circumferentially disposed distributor cap output terminals by a predetermined arc gap while said segment member is rotated with said body member and a pair of electrical conductor members of an electrically conductive paint in electrical contact with said body and segment members radially inwardly from said output tip portion of said segment member, the improvement comprising:

respective depressions in said body member that are filled by said electrically conductive paint, are shaped to form the said electrically conductive paint contained therein into respective sharp terminating points, are so positioned that the said electrically conductive paint contained therein extends outwardly toward said output tip portion and are so oriented that said sharp terminating points define a pair of circumferentially displaced sharp corona generating points.

3. In an ignition distributor rotor of the type adapted to be rotated about its axis within a distributor cap having a plurality of output terminals circumferentially disposed about the rotor axis of rotation and including a body member of an electrical insulating material;

a segment member of an electrically conductive material supported by said body member and having an output tip portion that traces a circular path radially inwardly from said circumferentially disposed distributor cap output terminals by a predetermined arc gap while said segment member is rotated with said body member and a pair of electrical conductor members of an electrically conductive paint in electrical contact with said body and segment members radially inwardly from said output tip portion of said segment member and supported by said body member in a plane axially displaced from and substantially parallel to said circular path traced by said output tip portion, the improvement comprising:

respective depressions in said body member that are filled by said electrically conductive paint, are shaped to form the said electrically conductive paint contained therein into respective sharp terminating points, are so positioned that the said electrically conductive paint contained therein extends outwardly in a diverging relationship toward said output tip portion and are so oriented that said sharp terminating points define a pair of circumferentially displaced sharp corona generating points.

4. In an ignition distributor rotor of the type adapted to be rotated about its axis within a distributor cap having a plurality of output terminals circumferentially disposed about the rotor axis of rotation and including a body member of an electrical insulating material; a segment member of an electrically conductive material supported by said body member and having an output tip portion that traces a circular path radially inwardly from said circumferentially disposed distributor cap output terminals by a predetermined arc gap while said segment member is rotated with said body member and at least one conductor member of an electrically conductive paint in electrical contact with said body and segment members radially inwardly from said output tip portion of said segment member and supported by said body member in a plane axially displaced from and substantially parallel to said circular path traced by said output tip portion, the improvement comprising: at least one depression in said body member that is filled by said electrically conductive paint, is shaped to form the said electrically conductive paint contained therein into a sharp terminating point, is so positioned that the said electrically conductive paint contained therein extends outwardly toward said output tip portion and is so oriented that the said sharp terminating point so formed thereby defines a sharp corona generating point remote from the point of said electrical contact.

* * * * *